US011378347B2

(12) United States Patent
Kincel et al.

(10) Patent No.: US 11,378,347 B2
(45) Date of Patent: Jul. 5, 2022

(54) BUFFER WITH MAGNETIC BIAS

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: BRAVO COMPANY MFG, INC., Hartland, WI (US)

( * ) Notice: Subject to any disclaimer, the term of this patent is extended or adjusted under 35 U.S.C. 154(b) by 362 days.

(21) Appl. No.: 16/520,723

(22) Filed: Jul. 24, 2019

(65) Prior Publication Data

US 2021/0025665 A1 Jan. 28, 2021

(51) Int. Cl.
*F41A 3/84* (2006.01)

(52) U.S. Cl.
CPC ..... *F41A 3/84* (2013.01)

(58) Field of Classification Search
CPC ..... F41A 3/84
See application file for complete search history.

(56) References Cited

U.S. PATENT DOCUMENTS 2,831,404 A * 4/1958 Sampson ..... F41A 3/78 89/198
3,366,011 A * 1/1968 Sturtevant ..... F41C 23/06 89/198
3,405,470 A * 10/1968 Wesemann ..... F41A 25/02 42/74
5,279,202 A * 1/1994 Bellardi ..... F41A 3/82 89/130
5,726,377 A * 3/1998 Harris ..... F41A 19/14 42/65
6,684,549 B2 * 2/2004 Bragg ..... F41C 23/08 42/74
6,829,974 B1 * 12/2004 Gwinn, Jr. ..... F41A 3/70 89/130
7,131,367 B1 * 11/2006 Boerschig ..... F41A 3/94 89/198
7,478,495 B1 * 1/2009 Alzamora ..... F41C 23/04 42/74
7,827,722 B1 * 11/2010 Davies ..... F41C 23/16 42/75.02
8,051,593 B2 * 11/2011 Vesligai ..... F41C 23/00 42/73
8,296,984 B2 * 10/2012 Kincel ..... F41A 25/12 42/1.06
8,430,015 B2 * 4/2013 Faifer ..... F41A 25/12 89/44.01

(Continued)

OTHER PUBLICATIONS

TFB TV, "New Products of VLTOR Weapons Systems", website: https://www.thefirearmblog.com/blog/2019/01/28/shot-2019-new-products-of-vltor-weapon-systems/, Jan. 28, 2019.

(Continued)

*Primary Examiner* — Michelle Clement
(74) *Attorney, Agent, or Firm* — Michael Best & Friedrich LLP

(57) ABSTRACT

A buffer assembly for a firearm includes an internal assembly comprising a plurality of weights within a buffer body of a buffer and at least one magnet. The magnet at least partially offsets an inertial event that occurs during a firing action of the firearm.

25 Claims, 9 Drawing Sheets

(56) References Cited

U.S. PATENT DOCUMENTS 8,943,726 B2 * 2/2015 Kincel ..... F41C 23/06 42/1.06
9,080,823 B1 * 7/2015 Mantas ..... F41A 3/84
9,103,611 B2 * 8/2015 Neitzling ..... F41A 3/12
9,341,437 B1 * 5/2016 Huang ..... F41A 3/84
9,739,566 B2 * 8/2017 Huang ..... F41C 23/06
9,829,260 B2 * 11/2017 Geissele ..... F41A 3/84
9,879,930 B2 * 1/2018 Cassels ..... F41A 3/84
9,915,492 B2 * 3/2018 Huang ..... F41C 23/08
9,921,013 B1 * 3/2018 Oglesby ..... F41A 3/80
9,970,722 B1 * 5/2018 Babb ..... F41A 3/82
9,995,553 B1 * 6/2018 Oglesby ..... F41C 23/06
10,054,378 B2 * 8/2018 Pawlowski ..... F41A 3/84
10,088,266 B1 * 10/2018 Fournerat ..... F41C 23/06
10,415,907 B1 * 9/2019 Kincel ..... F41A 3/84
10,488,129 B2 * 11/2019 Myers ..... F41A 3/84
10,557,674 B1 * 2/2020 Mantas ..... F41A 3/84
10,619,956 B1 * 4/2020 Zhang ..... F41A 3/84
10,712,108 B2 * 7/2020 Cozad ..... F41A 3/84
10,852,083 B2 * 12/2020 Underwood ..... F41A 3/84
10,982,918 B2 * 4/2021 Newberry ..... F41A 3/82
2002/0178901 A1 * 12/2002 Bergstrom ..... F41A 3/94 89/198
2003/0154640 A1 * 8/2003 Bragg ..... F41C 23/08 42/74
2006/0048637 A1 * 3/2006 Dimitrios ..... F41A 3/86 89/14.3
2006/0236853 A1 * 10/2006 Boersching ..... F41A 3/70 89/198
2008/0110074 A1 * 5/2008 Bucholtz ..... F41C 23/06 42/1.06
2010/0050492 A1 * 3/2010 Faifer ..... F41A 3/84 42/1.06
2010/0122482 A1 * 5/2010 Simms ..... F41C 23/08 42/1.06
2010/0251587 A1 * 10/2010 Kincel ..... F41C 23/06 42/1.06
2010/0251588 A1 * 10/2010 Kincel ..... F41C 23/04 42/1.06
2011/0000363 A1 * 1/2011 More ..... F41H 7/005 89/43.01
2011/0239852 A1 * 10/2011 Kirstein ..... F41A 3/14 89/180
2013/0192114 A1 * 8/2013 Christenson ..... F41A 3/84 42/16
2013/0316308 A1 * 11/2013 Monti ..... F41A 33/02 434/16
2013/0319217 A1 * 12/2013 Gangl ..... F41A 3/84 89/198
2014/0075798 A1 * 3/2014 Kincel ..... F41A 3/84 42/1.06
2014/0224112 A1 * 8/2014 Verry ..... F41A 3/80 89/130
2015/0226507 A1 * 8/2015 Palmer ..... F41A 1/08 89/1.703
2018/0087864 A1 * 3/2018 Lowrance ..... F41A 33/06
2019/0017765 A1 * 1/2019 Bender ..... F41A 19/04
2019/0353447 A1 * 11/2019 Palenik, II ..... F41A 21/38
2021/0025665 A1 * 1/2021 Kincel ..... F41A 3/84
2021/0025669 A1 * 1/2021 Griffin ..... F41C 23/06
2021/0164742 A1 * 6/2021 Snyder ..... F16F 15/03

OTHER PUBLICATIONS

NRA Shooting Illustrated, "First Look: ODIN Works AR-15 Adjustable Buffer Set" website: https://www.shootingillustrated.com/articles/2019/5/30/first-look-odin-works-ar-15-adjustable-buffer-set/, May 30, 2019.

TFB TV, "Strike Industries OPTIMUS Modular Weight Buffer", website: https://www.thefirearmblog.com/blog/2019/09/12/strike-industries-optimus-modular-weight-buffer/, Sep. 12, 2019.

* cited by examiner

BUFFER WITH MAGNETIC BIAS

BACKGROUND

The present invention relates to a buffer assembly for a firearm. The buffer assembly includes at least one magnet that offsets an inertial event that occurs during the firing action of a firearm.

SUMMARY

The invention provides a buffer assembly for a firearm, the buffer assembly comprising: a buffer tube including a closed rear end; an action spring in the tube; and a buffer in the tube and engaging the action spring, the buffer including a buffer body defining an internal buffer cavity, a rear end cap covering a rear end of the buffer body, a front end cap covering a front end of the buffer body, and an internal assembly within the buffer cavity, the internal assembly comprising at least one weight, a first magnet and a second magnet wherein a magnetic repelling force between the first magnet and the second magnet biases the weight to an at-rest position within the internal assembly; and wherein in response to an inertial event the at least one weight overcomes the bias of the magnetic repelling force to achieve a dead-blow condition to at least partially offset an effect of the inertial event.

In some embodiments, the magnetic repelling force establishes a delay interval between the occurrence of the inertial event and the occurrence of the resulting dead-blow condition. In some embodiments, the first magnet is encapsulated with the weight in an encapsulation. In some embodiments, the inertial event is generated by a rearward stroke of the buffer and the dead-blow condition occurs at the beginning of the rearward stroke. In some embodiments, the first magnet is proximate the weight and the second magnet is at least partially disposed within the rear end cap of the buffer body. In some embodiments, the magnetic repelling force adjusts a magnitude of an impact force arising from the dead-blow condition. In some embodiments, the inertial event is generated by a rearward stroke of the buffer and the dead-blow condition occurs at both a beginning of the rearward stroke and an end of the rearward stroke. In some embodiments, the at least one weight includes a first weight and a second weight, the first weight located rearwardly within the buffer body relative to the second weight, the first magnet is positioned proximate the first weight, and the second magnet is positioned proximate the second weight. In some embodiments, the magnetic repelling force resets the internal assembly to the at-rest condition after a recover time has passed following the occurrence of the dead-blow condition.

The invention also provides a firing assembly for a firearm, the firing assembly comprising: a bolt carrier movable in a rearward stroke and a forward stroke as part of a firing and loading action of the firearm; and a buffer assembly including a buffer tube including a closed rear end, an action spring in the tube, and a buffer in the tube and engaging the action spring, the buffer including a buffer body defining an internal buffer cavity, a rear end cap covering a rear end of the buffer body, a front end cap engaged with the bolt carrier, and an internal assembly within the buffer cavity, the internal assembly comprising at least one weight, a first magnet, and a second magnet; wherein a magnetic repelling force between the first magnet and the second magnet biases the weight to an at-rest position within the internal assembly; wherein the buffer is driven in rearward and forward strokes corresponding to the rearward and forward strokes of the bolt carrier and under the influence of respective rearward motion of the bolt carrier and a forward biasing force of the action spring; wherein as a result of at least one of the rearward and forward strokes, at least one inertial event occurs; wherein in response to the inertial event the at least one weight overcomes the bias of the magnetic repelling force to achieve a dead-blow condition to at least partially offset an effect of the inertial event.

In some embodiments, the magnetic repelling force adjusts a magnitude of an impact force arising from the dead-blow condition. In some embodiments, the magnetic repelling force establishes a delay interval between the occurrence of the inertial event and to the occurrence of the dead-blow condition. In some embodiments, the inertial event is generated by a rearward stroke of the buffer and the dead-blow condition occurs at the end of the rearward stroke. In some embodiments, the second magnet is proximate the weight and the first magnet is at least partially disposed within the front end cap of the buffer body. In some embodiments, a magnetic attracting force between the first magnet and the bolt carrier biases the bolt carrier towards the buffer body. In some embodiments, the first magnet is proximate the weight and the second magnet is at least partially disposed within the rear end cap of the buffer body, wherein the internal assembly further comprises a third magnet disposed at least partially within the front end cap of the buffer body, and wherein a magnetic attracting force between the third magnet and the bolt carrier biases the bolt carrier towards the buffer body. In some embodiments, a radius of the third magnet is larger than a radius of the cavity of the buffer body. In some embodiments, the magnetic repelling force resets the internal assembly to the at-rest condition after a recover time has passed following the occurrence of the dead-blow condition.

The invention also provides a method of at least partially offsetting an inertial event in a firing assembly of a firearm, the method comprising: evaluating an inertial event of a buffer assembly in a firearm, the buffer assembly having a buffer body, with at least one weight moveable within an internal space of the buffer body, and a first magnet and a second magnet between which a magnetic repelling force biases the weight to an at-rest position in the internal assembly, wherein in response to the inertial event the at least one weight overcomes the bias of the magnetic repelling force to achieve a dead-blow condition to at least partially offset an effect of the inertial event, and wherein the magnetic repelling force adjusts a magnitude of an impact force arising from the dead-blow condition and establishes a delay interval between the occurrence of the inertial event and to the occurrence of the dead-blow condition; determining an impact force that is a minimizing impact force and a delay interval that is a minimizing delay interval such that the minimizing impact force and minimizing delay interval combination at least partially offset the inertial event; and adjusting properties of the components of the firearm to achieve the minimizing impact force and the minimizing delay interval combination.

In some embodiments, the adjusted component properties are those of the first magnet and the second magnet. In some embodiments, the adjusted component properties are those of the weight. In some embodiments, the adjusted component properties are those of the encapsulation.

The invention also provides a firing assembly for a firearm, the firing assembly comprising: a bolt carrier movable in a rearward stroke and a forward stroke as part of a firing and loading action of the firearm; and a buffer assembly including a buffer tube including a closed rear end, an action spring in the tube, and a buffer in the tube and engaging the action spring, the buffer including a buffer body defining an internal buffer cavity, a rear end cap covering a rear end of the buffer body, a front end cap engaged with the bolt carrier, and an internal assembly within the buffer cavity, the internal assembly comprising at least one weight and a magnet; wherein a magnetic attracting force between the magnet and the bolt carrier biases the bolt carrier and the buffer towards each other; wherein the buffer is driven in rearward and forward strokes corresponding to the rearward and forward strokes of the bolt carrier and under the influence of respective rearward motion of the bolt carrier and a forward biasing force of the action spring; wherein as a result of at least one of the rearward and forward strokes, at least one inertial event occurs; wherein during the inertial event, the magnetic attracting force biases the bolt carrier and the buffer towards each other to at least partially offset an effect of the inertial event.

In some embodiments, the internal assembly includes a dead-blow biasing mechanism. In some embodiments, the dead-blow biasing mechanism includes at least a second magnet.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
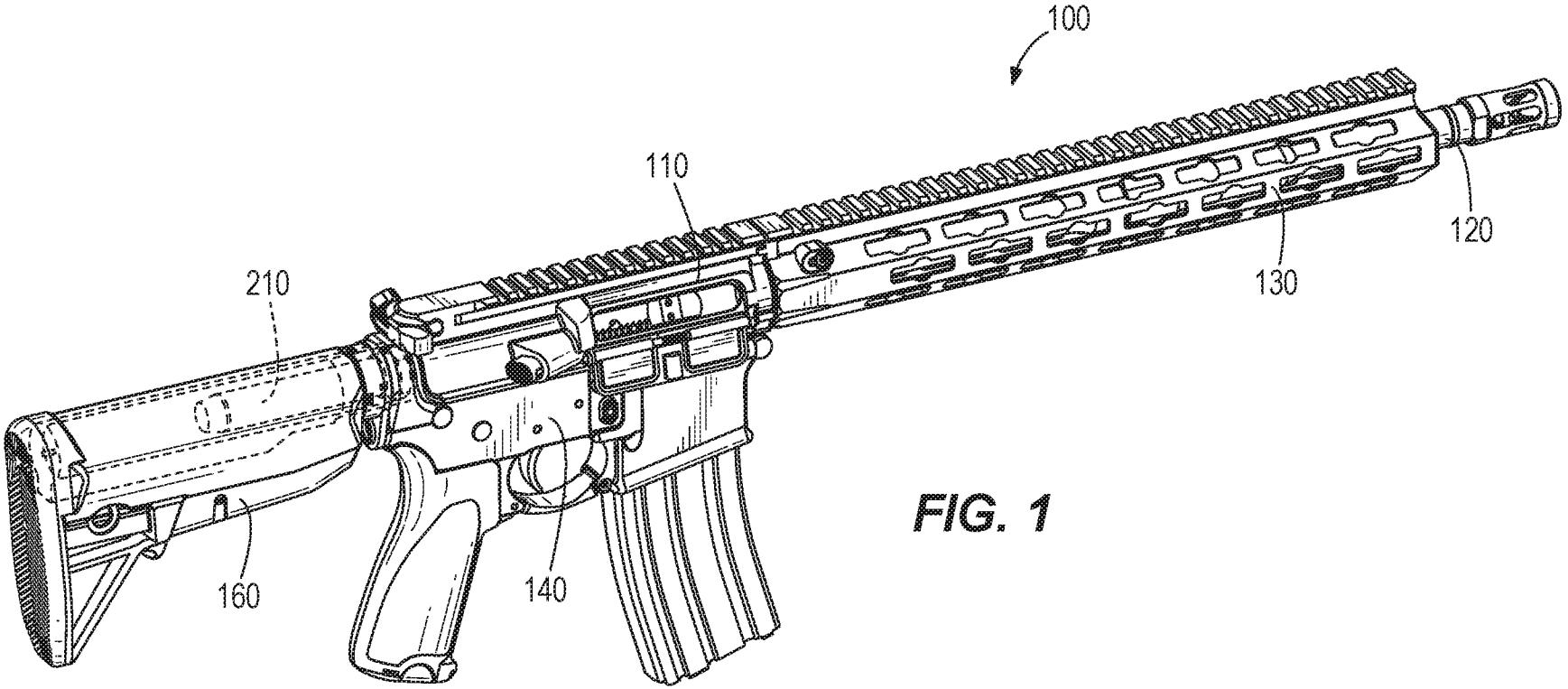
FIG. 1 illustrates an exemplary firearm including an embodiment of the present invention.

FIG. 1 illustrates an exemplary firearm 100 which may embody the present invention. For the purposes of this disclosure, directional and relative terms such as front, forward, rear, and rearward are used from the perspective of a firearm operator using the firearm 100 in its intended way. The illustrated firearm 100 is an AR-15 rifle and includes an upper receiver assembly 110 to which a barrel 120, hand guard 130, lower receiver 140, and buttstock 160 are mounted. The components are generally conventional and well known. A buffer assembly 210 is mounted to the lower receiver 140 and extends into the buttstock 160.

Figure 2:
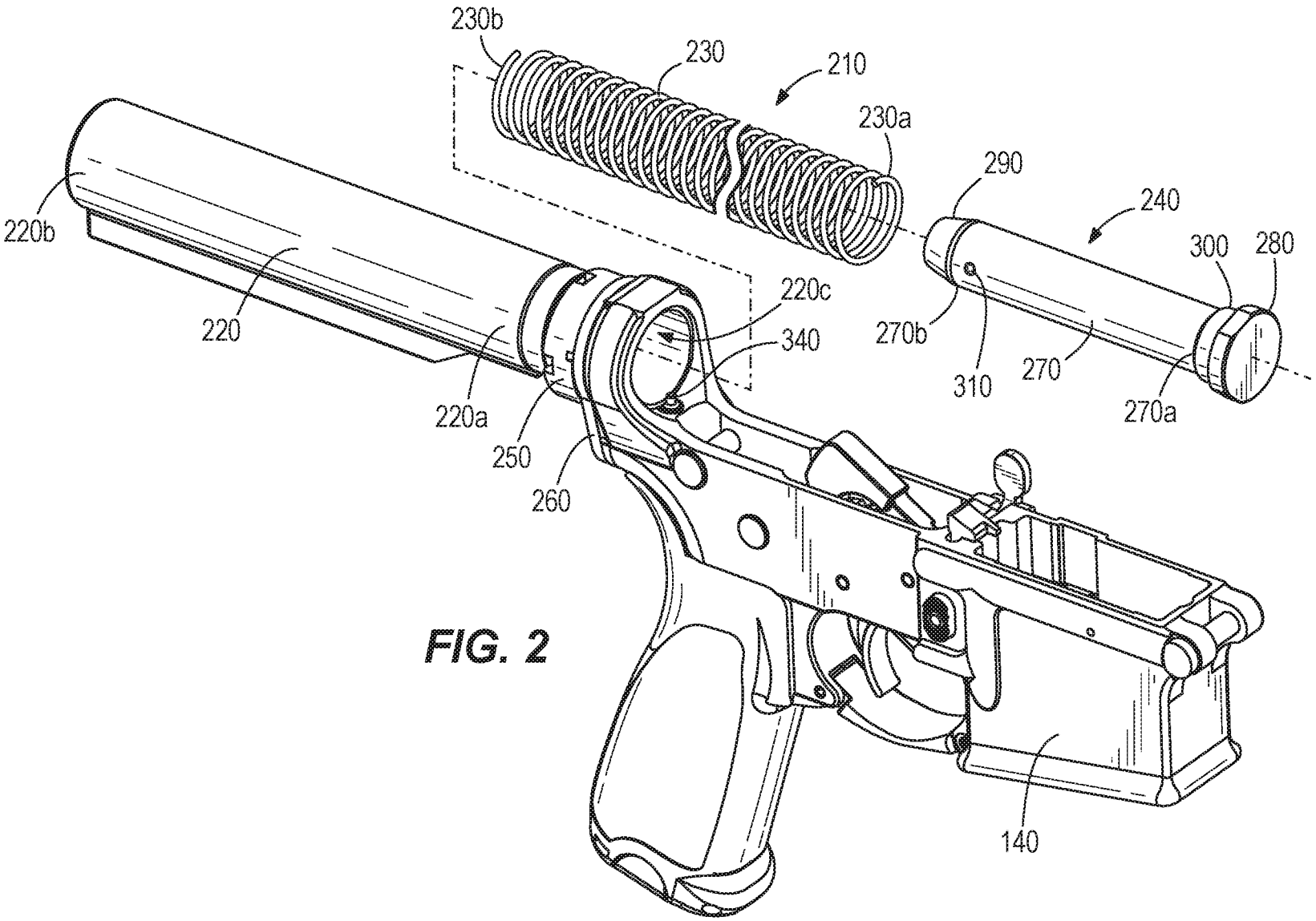
FIG. 2 is an exploded view of a lower receiver assembly of the firearm, including a buffer assembly having a buffer.

FIG. 2 illustrates the buffer assembly 210, which includes a buffer tube 220, an action spring 230, and a buffer 240. The buffer tube 220 includes an open front end 220*a*, a closed rear end 220*b*, and a longitudinally-extending internal space 220*c*. The open front end 220*a* of the buffer tube 220 is mounted to the rear of the lower receiver 140 with a castle nut 250 and a receiver end plate 260. The buffer tube 220 extends rearwardly from the lower receiver 140 into the buttstock 160. The action spring 230 is a coil compression spring having a front end 230*a* and a rear end 230*b*.

The buffer 240 includes a cylindrical buffer body 270, a front end cap 280, and a rear end cap 290. The buffer body 270 includes a front end 270*a* and a rear end 270*b*. The front end cap 280 may be threaded onto the front end 270*a* of cylindrical buffer body 270, permanently affixed to the buffer body 270, or integrally formed with the buffer body 270. The front end cap 280 is of wider diameter than the buffer body 270 to define a shoulder 300. The rear end cap 290 is made of a resilient material such as urethane to cushion the impact of the buffer 240 on the rear end 220*b* of the internal space 220*c* of the buffer tube 220 when the buffer 240 is driven rearward as part of the firearm's firing and reloading action. A retaining pin or roll pin 310 secures the rear end cap 290 to the buffer body 270.

The action spring 230 and buffer 240 are inserted through the open front end 220*a* of the buffer tube 220 into the internal space 220*c*. The rear end 230*b* of the action spring 230 bottoms out in and abuts against the closed rear end 220*b* of internal space 220*c* of the buffer tube 220. The buffer body 270 is surrounded by the coils of the action spring 230. The front end 230*a* of the action spring 230 abuts the shoulder 300 of the front end cap 280. The action spring 230 and buffer 240 are retained in the buffer tube 220 with a buffer retaining pin 340 in the lower receiver 140. The buffer retaining pin 340 is spring biased and can be manually deflected into the lower receiver 140 to provide clearance for insertion of the action spring 230 and buffer 240. When released from its deflected condition, the buffer retaining pin 340 extends to trap the action spring 230 and buffer 240 in the buffer tube 220.

Figure 3:
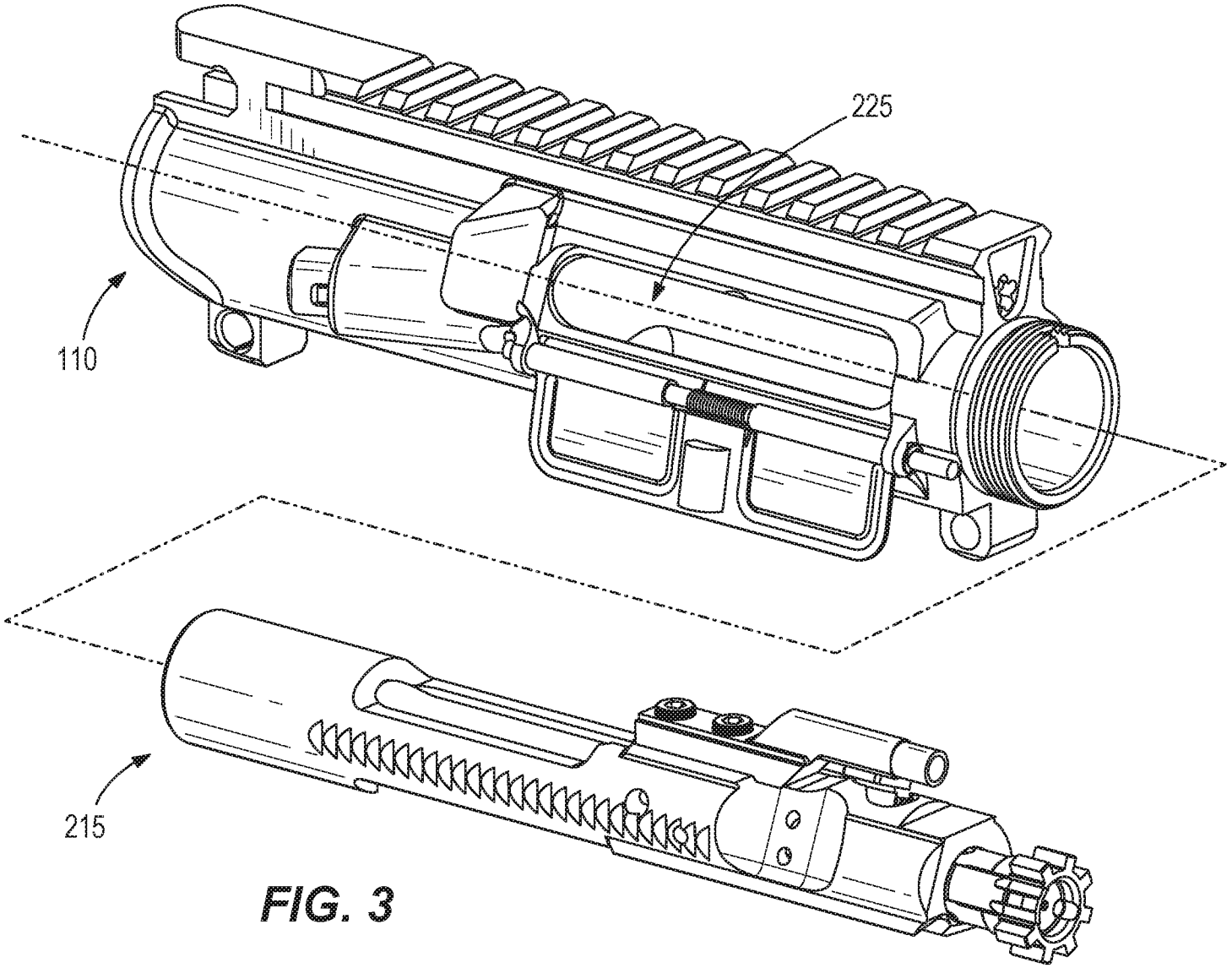
FIG. 3 is an exploded view of an upper receiver assembly of the firearm and a bolt carrier.

FIG. 3 illustrates a bolt carrier 215. The bolt carrier 215 is engaged with the front end cap 280 of the buffer 240 and reciprocates in the upper receiver 110 as part of the firing action of the firearm 100. The bolt carrier 215 is in a battery condition when fully forward in the upper receiver 110 and locked with respect to the barrel 120. The firearm 100 may be fired when in the battery condition, which drives a bullet out of the barrel 120 under the influence of rapidly expanding barrel gases. The barrel gases are recycled from the barrel 120 to drive the bolt carrier 215, and thereby the buffer 240, rearward. This can be done by either directly impinging the barrel gases rearwardly on the bolt carrier 215 or by driving a piston rearwardly under the influence of the barrel gases to strike the bolt carrier 215. In any event, the barrel gases are the motive force for the rearward motion (called a rearward stroke) of the bolt carrier 215. During the rearward stroke, a spent shell from the just-fired round is ejected through a side door of the upper receiver 110 and the action spring 230 is compressed in the buffer tube 220. The rearward stroke ends when the rear end cap 290 bottoms out against the rear end 220*b* of the buffer tube 220.

A forward stroke commences under the influence of the action spring 230. During the forward stroke, the action spring 230 drives the buffer 240 and bolt carrier 215 forward. The bolt carrier 215 collects a new round from a magazine under the upper receiver 110 and drives the new round into the battery condition. The forward stroke ends when the bolt carrier 215 is in the battery condition, ready to fire the new round.

The present invention relates to a dead-blow mechanism inside the buffer body 270, and more specifically to a magnetic dead-blow biasing mechanism 460 which is part of the dead-blow mechanism. As will be discussed in more detail below, the dead-blow mechanism has two conditions: an at-rest condition and a dead-blow condition. The dead-blow biasing mechanism 460 biases the dead-blow mechanism into the at-rest condition. The dead-blow condition is achieved by overcoming the biasing force of the dead-blow biasing mechanism 460 in response to an inertial event. The purposes of the dead-blow mechanism in the buffer body 270 is to reduce bounce of the bolt carrier 215 or slow down acceleration of the bolt carrier 215 at the beginning or end of the rearward stroke or the beginning or end of the forward stroke, when inertial events occur. Reducing bounce and slowing down acceleration can improve shooting accuracy and optimize the timing of the firing action, as will be described in more detail below.

FIGS. 4A-10C illustrate various configurations (referred to as "embodiments" herein) of an internal assembly 410, 510, 610, 710, 810, 910, 1010 of the buffer 240. The internal assembly 410, 510, 610, 710, 910, 1010 is received in a buffer cavity 270*c* inside the buffer body 270. Each internal assembly 410, 510, 610, 710, 810, 910, 1010 includes a plurality of conventional masses (referred to as "weights" herein) 420, 421 and conventional resilient spacers 430. In the illustrated embodiments, the spacers 430 are rubber. The plurality of conventional weights 420, 421 includes a forwardmost weight (421*f* or 420*f*) and a rearmost weight (421*r* or 420*r*). Although the illustrated embodiment includes four identically-dimensioned weights 420, 421, it will be understood for the purposes of these embodiments that there may be more or fewer weights having different dimensions depending on the particular application and desired performance of the buffer 240. The weights 420, 421 may also be made of different materials having different densities to arrive at the desired functionality for the particular application. Although the weights 420, 421 may be made of any ferrous or non-ferrous material, preferably the weights 420, 421 are made of a material that is as dense as, and that weighs an equal amount as or more than, stainless steel. In the illustrated embodiments, the weights 420 are preferably made of tungsten, or of another high-density metal material, and the weights 421 are preferably made of carbon steel, stainless steel, or some other material with similar properties. The weights 420 have planar, flat forward and rearward ends. The spacers 430 are positioned between the flat ends of adjacent weights 420, 421.

The illustrated embodiments also include a magnetic dead-blow biasing mechanism 460 in the form of a first magnet 450*a* and a second magnet 450*b* (the embodiment illustrated in FIG. 9 may or may not include a dead-blow biasing mechanism 460). In each embodiment, like poles (i.e., north or south) of the first and second magnets 450*a*, 450*b* face each other to create a repelling biasing force. Each embodiment has an at-rest condition which is the condition into which the internal assemblies 410, 510, 610, 710, 810, 910, 1010 (or more specifically the position into which the weights 420, 421) are biased by the magnetic dead-blow biasing mechanism 460. Each embodiment also has a dead-blow condition in which the biasing force of the dead-blow biasing mechanism 460 has been overcome by inertia forces that bring the magnets 450*a*, 450*b* into contact or into close proximity. The dead-blow biasing mechanism 460 resets the internal assemblies 410, 510, 610, 710, 810, 910, 1010 to the at-rest condition after a sufficient recovery time has passed following the occurrence of the dead-blow condition.

As will be explained below, the magnetic dead-blow biasing mechanism 460 can be configured to achieve the dead-blow condition at the end of the rearward stroke, the beginning of the rearward stroke, or at both the beginning and end of the rearward stroke. The magnetic dead-blow biasing mechanism 460 might be set up to achieve the dead-blow condition at the end of the rearward stroke when the action spring 230 is overly stiff or overly preloaded. In this situation, referred to as "oversprung," the action spring 230 may cause the buffer 240 and bolt carrier 215 to transition from the rearward stroke to the forward stroke too quickly, which can cause the cycle of the action to operate too quickly. If the cycle of the action is too quick, the next round may not be properly gathered and loaded into battery condition by the bolt carrier 215. The magnetic dead-blow biasing mechanism 460 might be setup to achieve the dead-blow condition at the beginning of the rearward stroke when too much barrel gas is used to initiate the rearward stroke. In this situation, referred to as "overgassed," the bolt carrier 215 jolts rearwardly too suddenly with the buffer 240, resulting in the bolt carrier 215 and the buffer 240 accelerating so quickly in the rearward direction that the bolt carrier 215 and the buffer 240 rebound off the rear end 220*b* of the buffer tube 220. The magnetic dead-blow biasing mechanism 460 may be set up to achieve the dead-blow condition at both the end and beginning of the rearward stroke when the action is slightly oversprung and overgassed.

One factor that must be considered when designing the magnetic dead-blow biasing mechanism 460 is a delay interval. The delay interval is the time it is expected to take for the weights 420, 421 to overcome the bias of the magnetic dead-blow biasing mechanism 460 and come to a dead-blow condition after an inertial event has occurred. Inertial events include the buffer 240 suddenly ceasing movement after being in motion and when the buffer 240 suddenly goes into motion from an at-rest position. Examples of inertial events arising from the buffer 240 suddenly ceasing movement include: (i) the buffer 240 striking the rear end 220*b* of the buffer tube 220 at the end of the rearward stroke; (ii) the buffer 240 striking the bolt carrier 215 during an initial period of the forward stroke if the buffer 240 and bolt carrier 215 become separated; and (iii) the bolt carrier 215 reaching the battery condition at the end of the forward stroke. Examples of inertial events arising from the buffer 240 suddenly going into motion include: (i) the start of the rearward stroke under the influence of barrel gases (by direct impingement or through a piston); and (ii) the start of the forward stroke under the influence of the action spring 230. The delay interval should be set to properly time the impact of the weights 420, 421 in the buffer 240 to offset a rebound 240 of the buffer 240 or to slow down an acceleration of the buffer 240.

An impact force provided by the weights 420, 421 after a delay interval reduces, minimizes, or eliminates bounce or rebound of the buffer 240 or slows down an acceleration of the buffer 240 after an inertial event. This effect is similar to the effect of a dead-blow hammer. For convenience, the dead-blow hammer effect just described is encompassed in the shorthand phrase "offset an inertial event." To achieve the dead-blow hammer effect to offset an inertial event of the buffer 240 for desirable firearm 100 operation, the delay interval and the impact force must be fine-tuned. The proper combination of delay interval and impact force results in desirable operation of the firearm, and the delay interval and impact force that create this combination can be referred to as minimizing delay interval and minimizing impact force respectively. If these variables are not fine-tuned, the inertial event of the buffer 240 will not be offset.

For example, if the delay interval is too short, the weights 420, 421 will cause the impact force too soon after an inertial event. In this situation, the impact force does not create a dead-blow effect, but instead amplifies bounce or fails to slow down acceleration. Alternatively, if the delay interval is too long, the weights 420, 421 will cause the impact force too late after the inertial event. In this scenario, the impact force occurs after the buffer 240 has already bounced and the buffer 240 bounces for a second time during the same stroke. In addition, if the impact force provided by the front and rear weights is too small it will not sufficiently cancel out the bounce of the buffer. If the impact force of the weights is too great it will more than cancel out the bounce of the buffer and the excess impact force will cause bounce.

To fine tune the delay interval and impact force such that the inertial event is at least partially offset, the inertial event must be evaluated for relevant parameters. Relevant parameters include at least the acceleration of the buffer 240 and the bolt carrier 215, as well as the length of time over which the inertial event takes place. Using these parameters, the required minimizing delay interval and minimizing impact force for offsetting the inertial event can be determined. The properties of components of the firearm can then be adjusted so that the firearm assembly operates with the minimizing delay interval and the minimizing impact force required for desirable firearm operation.

The delay interval and the impact force are functions of multiple factors, including at least: the mass of the weights 420, 421; the travel distance between at-rest condition and dead-blow condition; friction; and strength (e.g., magnitude) of the magnetic force of the magnets 450*a*, 450*b*. The magnitude of the magnetic force of the magnets 450*a*, 450*b* is generally a function of: (i) the permeability of space between the first and second magnets 450*a*, 450*b*; (ii) the magnetic field strength of the first and second magnets 450*a*, 450*b*; (iii) a length of a face-to-face distance between the first and second magnets 450*a*, 450*b*; and (iv) geometry of the first and second magnets 450*a*, 450*b*.

Figure 4A:
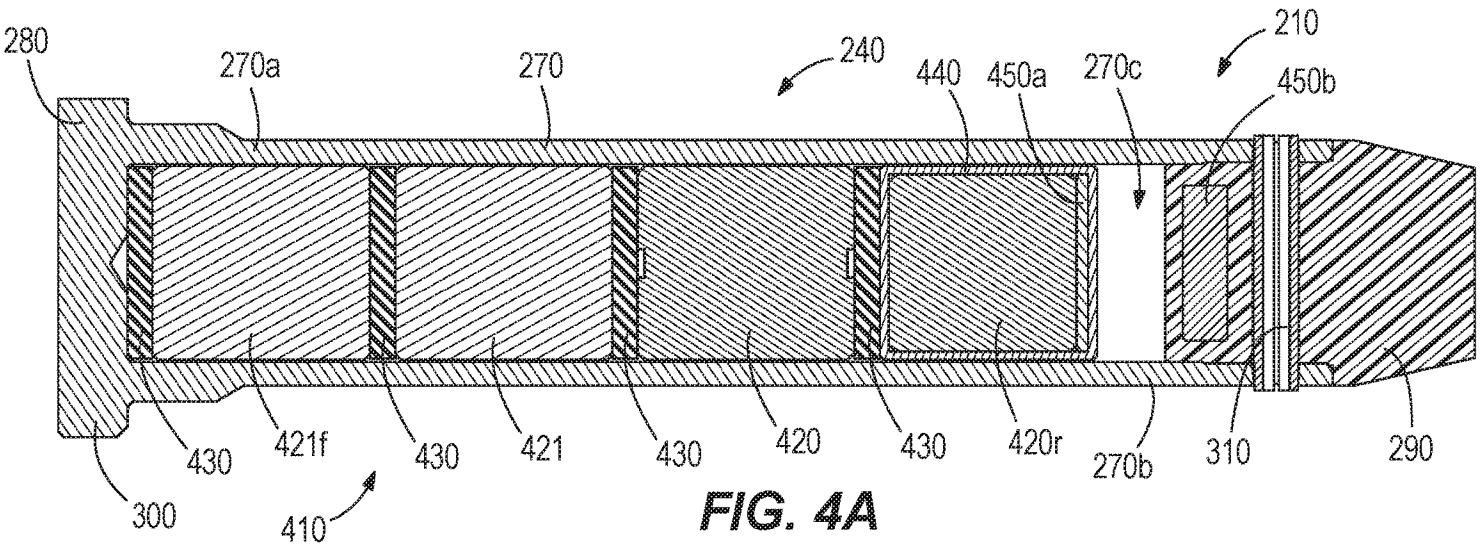
FIG. 4A is a cross-sectional view of a first embodiment of the buffer in an at-rest condition.
Figure 4B:
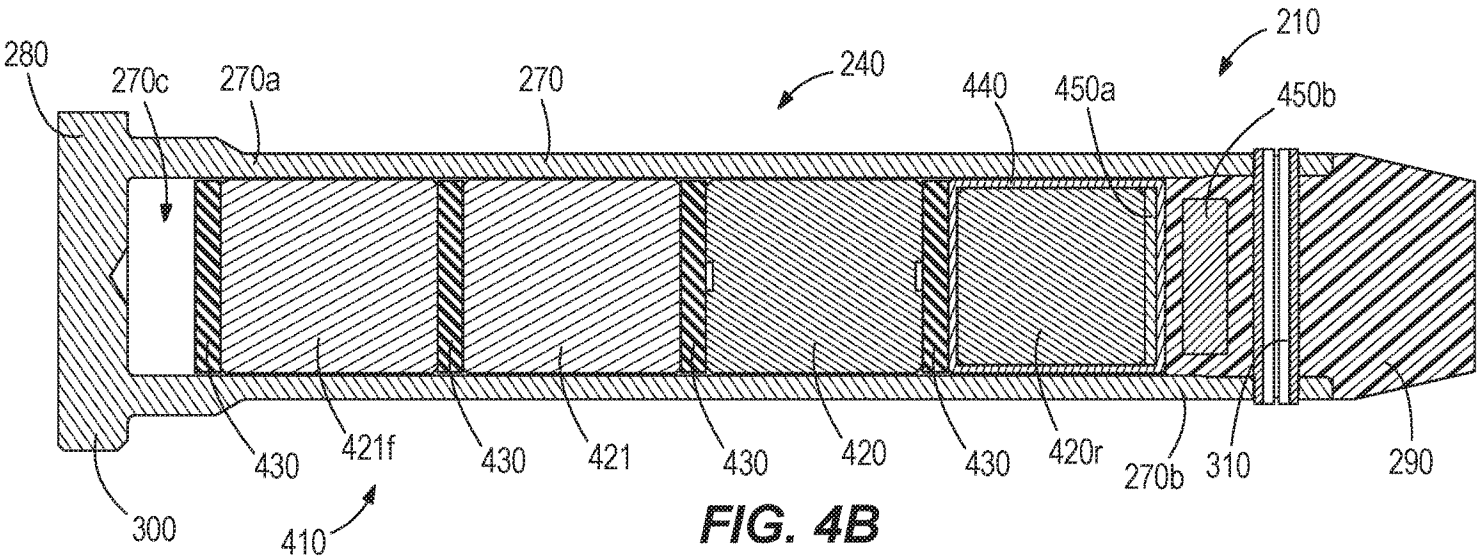
FIG. 4B is a cross-sectional view of the first embodiment of the buffer in a dead-blow condition.
Figure 5A:
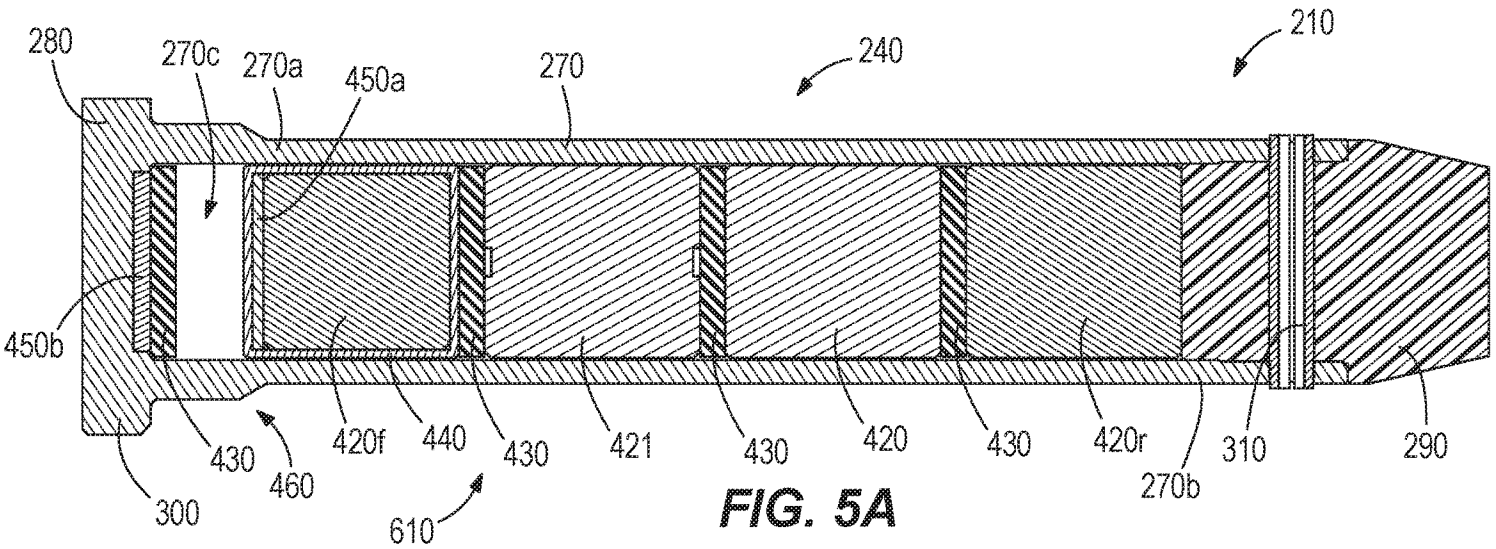
FIG. 5A is a cross-sectional view of a second embodiment of the buffer in an at-rest condition.
Figure 5B:
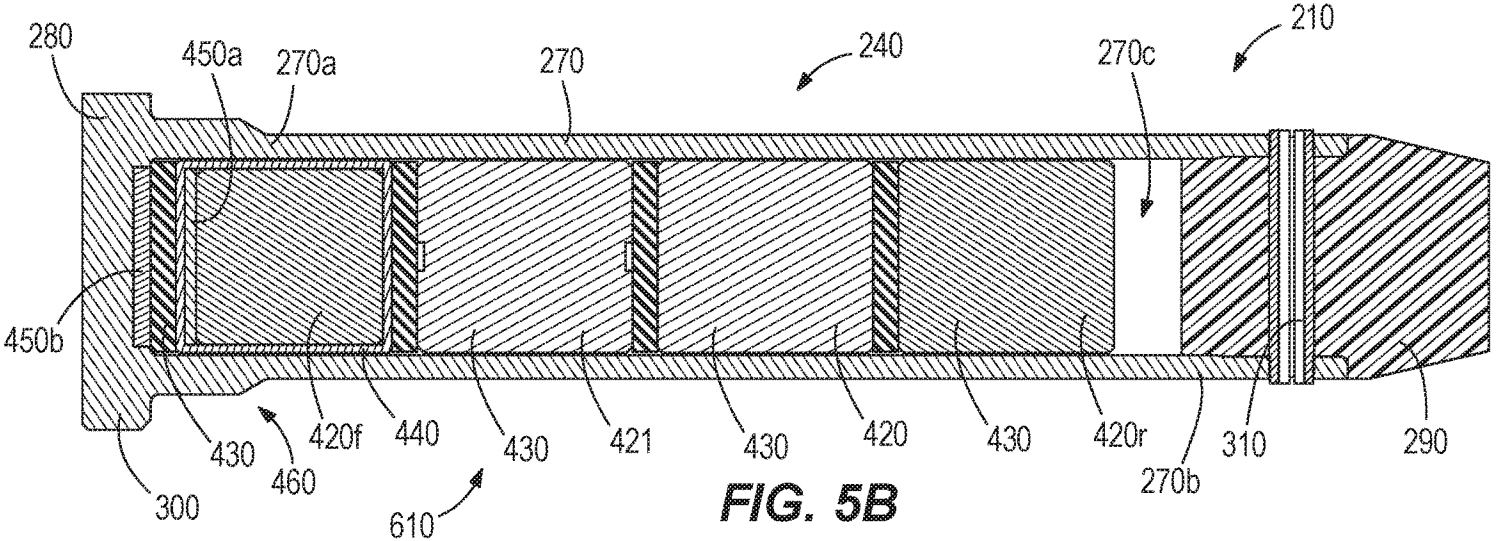
FIG. 5B is a cross-sectional view of the second embodiment of the buffer in a dead-blow condition.
Figure 6:
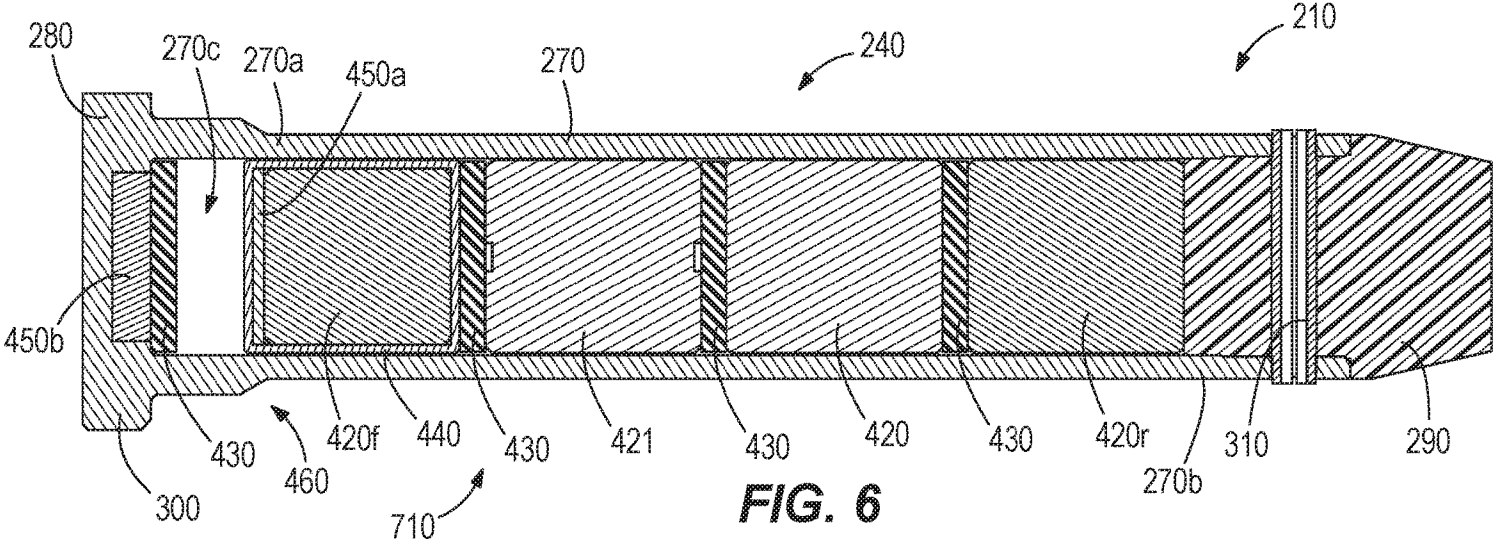
FIG. 6 is a cross-sectional view of a third embodiment of the buffer in an at-rest condition.
Figure 7:
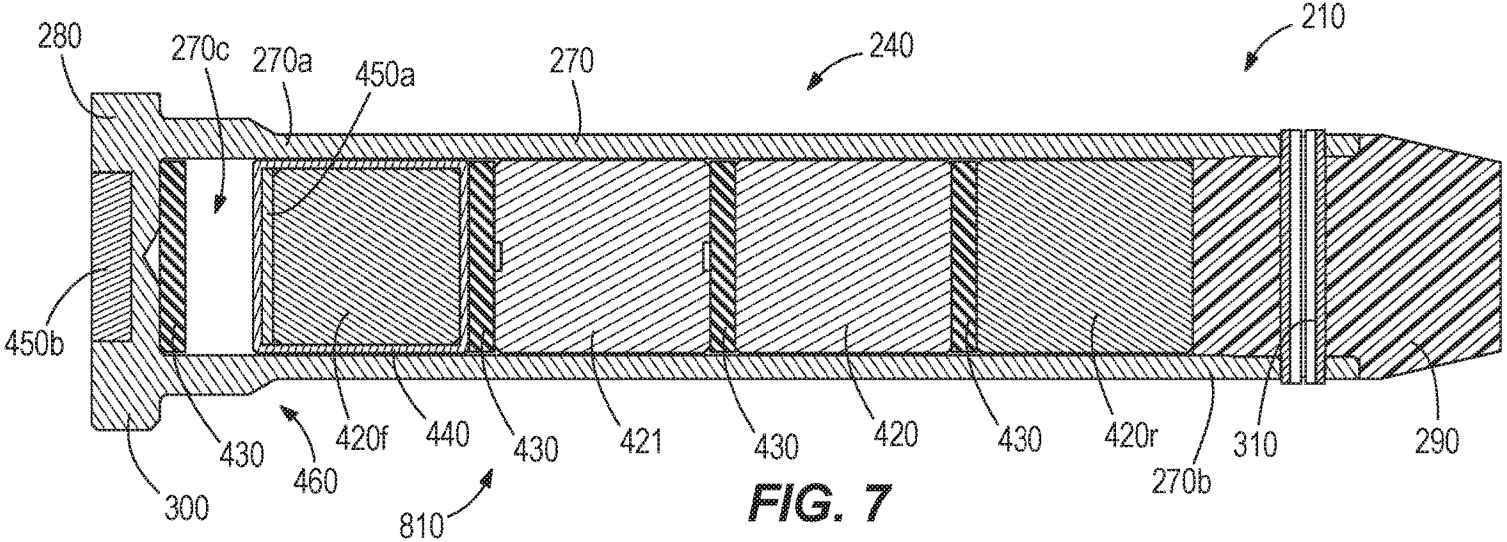
FIG. 7 is a cross-sectional view of a fourth embodiment of the buffer in an at-rest condition.

In all the embodiments, the material of an encapsulation 440 may be changed, in the embodiment illustrated in FIGS. 4A and 4B, the material of the rear end cap 290 may be changed, in the embodiment illustrated in FIGS. 5A-8C, the material of the spacers 430 may be changed, and in the embodiment illustrated in FIG. 7, the material of the buffer body 270 may be changed to fine-tune permeability of space and thereby the magnetic force. A combination of changing these materials may be used as well. Other methods of altering the permeability of space between the first and second magnets 450*a*, 450*b* include introducing various gases into the buffer cavity 270*c* of the buffer body 270 to change the permeability of space of air in the buffer cavity 270*c*. Also, changing the thicknesses of any of the components between the first and second magnets 450*a*, 450*b* will alter the magnetic force, since the total permeability of space between the first is a weighted ratio of the permeability of space of all of the components within the space between the first and second magnets 450*a*, 450*b*. Altering the types of the first and second magnets 450*a*, 450*b* may also change the magnetic field strength of the first and second magnets 450*a*, 450*b* to alter the magnetic force, since magnetic field strength is an intrinsic material property.

The geometry of the first and second magnets 450*a*, 450*b* may also be changed to alter the magnetic force. Also, the face-to-face distance between the first and second magnets 450*a*, 450*b* at the rearward-inertia condition and the forward-inertia condition may be altered by changing the length of some or all of the weights 420, 421, the length of some or all of the spacers 430, the thickness of the encapsulation 440, and/or the distance that the rear end cap 290 extends into the buffer cavity 270*c* of the buffer 240. Altering the face-to-face distance adjusts both the initial starting magnetic force exerted between the first and second magnets 450*a*, 450*b*, as well as the way in which the magnetic force is exerted between the first and second magnets 450*a*, 450*b* over time. Altering any of the variables of which the magnetic force is a function, either alone or in combination, may change the magnitude of the magnetic force. By changing the magnitude of the magnetic force, the delay interval and the impact force are also changed, and may be adjusted to achieve the desired minimizing delay interval and minimizing impact force.

Turning now to the illustrated embodiments, FIGS. 4A and 4B illustrate an internal assembly 410 designed to specifically address an overgassed firearm 100. The illustrated internal assembly 410 includes a first magnet 450*a* disposed on a rear face of the rearmost weight 420*r*, and a second magnet 450*b* held entirely within (e.g., encapsulated in) the rear end cap 290. In some embodiments, a portion of the second magnet 450*b* may be exposed to the buffer cavity 270*c* rather than completely contained within the end cap 290. The magnets 450*a*, 450*b* are arranged such that their ends of a same polarity (north or south) face each other and the magnets 450*a* and 450*b* exert repellent magnetic forces on each other. Preferably, the encapsulation material 440 is injection molded nylon, copper or nickel plating, or hardened epoxy dip, but other materials with similar properties may be used. FIG. 4A illustrates the internal assembly 410 in the at-rest condition and FIG. 4B illustrates the internal assembly 410 in the dead-blow condition following an inertial event and the delay interval.

The internal assembly 410 operates as follows. The internal assembly 410 is in the at-rest condition (FIG. 4A) when the bolt carrier 215 is in the battery condition (i.e., full forward). The rearward stroke starts under the influence of barrel gases (by direct impingement or through a piston), which is an inertial event causing the buffer body 270 to jolt rearwardly. The impact force arising from this inertial event are absorbed by the resilient spacers 430. When the buffer 240 bottoms out in the buffer tube 220, another inertial event occurs and the weights 420, 421 slam into the rear end cap 290 (FIG. 4B) to achieve the dead-blow condition. The dead-blow condition offsets the inertial event to reduces bounce of the bolt carrier 215 and the buffer 240 off the rear end 220*b* of the buffer tube 220 and makes the buffer 240 pause before starting the forward stroke. The dead-blow biasing mechanism 460 resets the internal assembly 410 to the at-rest condition (FIG. 4A) while the buffer 240 pauses. Then the action spring 230 drives the buffer 240 forward into the battery condition. If the force of the action spring 230 is sufficiently quick and forceful another inertial event may occur to again achieve the dead-blow condition, followed by the dead-blow mechanism 460 resetting the internal assembly 410 to the at-rest condition. Otherwise the internal assembly 410 remains in the at-rest condition for the full forward stroke. The resilient spacers 430 absorb impact force at the end of the forward stroke when the buffer 240 achieves battery condition.

FIGS. 5A and 5B illustrate a second configuration of an internal assembly 610 of the buffer 240 designed to specifically address an oversprung firearm 100. The internal assembly 610 has all the same components as the first embodiment 410, and differs only in the configuration. In the internal assembly 610, the first magnet 450*a* is disposed on a front face of the forwardmost weight 420*f*, and the second magnet 450*b* disposed within the front end cap 280 such that a portion of the second magnet 450*b* is exposed to the buffer cavity 270*c*. In some embodiments, the second magnet 450*b* may be held entirely within (i.e., completely encapsulated) the front end cap 280. The forwardmost weight 420*f* and the second magnet 450*b* are encapsulated together within an encapsulation 440. FIG. 5A illustrates the internal assembly 610 in an at-rest condition and FIG. 5B illustrates the internal assembly 610 in the dead-blow condition following an inertial event and the delay interval.

The internal assembly 610 operates as follows. The internal assembly 610 is in the at-rest condition (FIG. 4A) when the bolt carrier 215 is in the battery condition (i.e., full forward). The rearward stroke starts under the influence of barrel gases (by direct impingement or through a piston). If the influence of the barrel gases is sufficiently quick and forceful an inertial event may occur to achieve the dead-blow condition, followed by the dead-blow mechanism 460 resetting the internal assembly 610 to the at-rest condition. Otherwise the internal assembly 610 remains in the at-rest condition for the full rearward stroke. The resilient spacers 430 absorb impact force at the end of the rearward stroke when the buffer 240 bottoms out in the buffer tube 220. The forward stroke then starts under the influence of the action spring 230, which is an inertial event causing the buffer body 270 to jolt forwardly. The impact force arising from this inertial event are absorbed by the resilient spacers 430. When the buffer 240 tops out into battery condition, another inertial event occurs and the weights 420, 421 slam into the front end cap 280 (FIG. 4B) to achieve the dead-blow condition. The dead-blow condition offsets the inertial event to reduce bounce of the buffer 240 off the rear end of the bolt carrier 215. The dead-blow biasing mechanism 460 resets the internal assembly 410 to the at-rest condition (FIG. 4A) before the next rearward stroke begins.

In the embodiments illustrated in FIGS. 4A-5B, during an inertial event at the end of a rearward stroke or a forward stroke, the internal assembly 410, 510 within the buffer 240 offsets an inertial event. At the end of a forward stroke (i.e., a forward-directed inertial event), the internal assembly 410, 510 prevents the buffer 240 from bouncing off of the bolt carrier 215. The bolt carrier 215 cannot bounce at the end of a forward stroke because the bolt carrier 215 is locked into the battery position. At the end of a rearward stroke (i.e., a rearward-directed inertial event), the internal assembly similarly prevents the buffer 240 from bouncing off of the rear end 220*b* of the buffer tube 220. However, the bolt carrier 215 may bounce off the buffer 240 at the end of a rearward stroke if the dead-blow mechanism is not properly tuned to the combined masses of the buffer 240 and bolt carrier 215, which is difficult to accomplish in a dynamic rapidly-moving system such as a firearm.

FIG. 6 illustrates a third configuration or embodiment of an internal assembly 710 of the buffer 240 which addresses both an oversprung firearm and bounce of the bolt carrier 215 off the buffer 240 at the end of a rearward stroke. The internal assembly 710 is most similar to the second embodiment 610 and operates in an similar manner. The embodiment illustrated in FIG. 6 differs from the embodiment illustrated in FIGS. 5A and 5B in that the first magnet 450*b* of the third embodiment disposed within the front cap 280 is thicker and therefore more powerful than the magnet 450*b* of the second embodiment. The thicker and more powerful magnet 450*b* of the third embodiment has an additional advantage in that a front face of the magnet 450*b* may exert a large enough magnetic attracting force on the bolt carrier 215 to bias the bolt carrier 215 and buffer body 240 towards each other (i.e., magnetically couple the bolt carrier 215 and buffer body 240 so that the two components effectively move together as a single component).

The bolt carrier 215 therefore remains biased towards the front end cap 280 of the buffer 240 over the entire course of a firing action of a firearm. When an inertial event occurs at the end of a rearward stroke, the bolt carrier 215 remains biased towards (magnetically coupled to) the buffer 240 such that any bounce not offset by the resiliency of the rear end cap 290 and resilient spacers 430 in the buffer 240 is overcome by the magnetic attraction to further reduce or eliminate bounce of the bolt carrier 215 off of the buffer 240 (i.e., physical separation of the bolt carrier 215 from contact with the buffer 240). Additionally, the bolt carrier 215 remains biased towards the buffer 240 during an inertial event at the end of a forward stroke. The magnetic attracting force acts together with the weights 420, 421 coming to a dead-blow condition to bias the buffer 240 towards the bolt carrier 215 to further offset the inertial event and further reduce the bounce of the buffer 240 off of the bolt carrier 215. In some embodiments, the magnetic attracting force between the bolt carrier 215 and buffer 240 may be sufficiently strong to maintain engagement between the bolt carrier 215 and the buffer 240 during the entire firing and reloading action of the firearm. Additionally, the strength of the magnetic dead-blow biasing mechanism 460 enables a resilient spacers 430 to be positioned in the space between the two magnets 450*a*, 450*b* to reduce noise.

FIG. 7 illustrates a fourth embodiment of an internal assembly 810 of the buffer 240. The internal assembly 810 is most similar to the third embodiment 710 and operates in an similar manner. The embodiment illustrated in FIG. 7 differs from the embodiment illustrated in FIG. 6 in that a portion of the magnet 450*b* is exposed to the internal space 225 of the upper receiver 110. The exposed portion of the magnet 450*b* has the additional advantage in that, the magnet 450*b* of the fourth embodiment exerts a stronger attractive magnetic force on the bolt carrier 215 than the magnet 450*a* of the third embodiment. By exerting a stronger force between the bolt carrier 215 and the front end cap 280, the bolt carrier 215 and the buffer 240 are more effectively hindered from bouncing away from each other, further increasing the accuracy of the firearm 100.

Figure 8A:
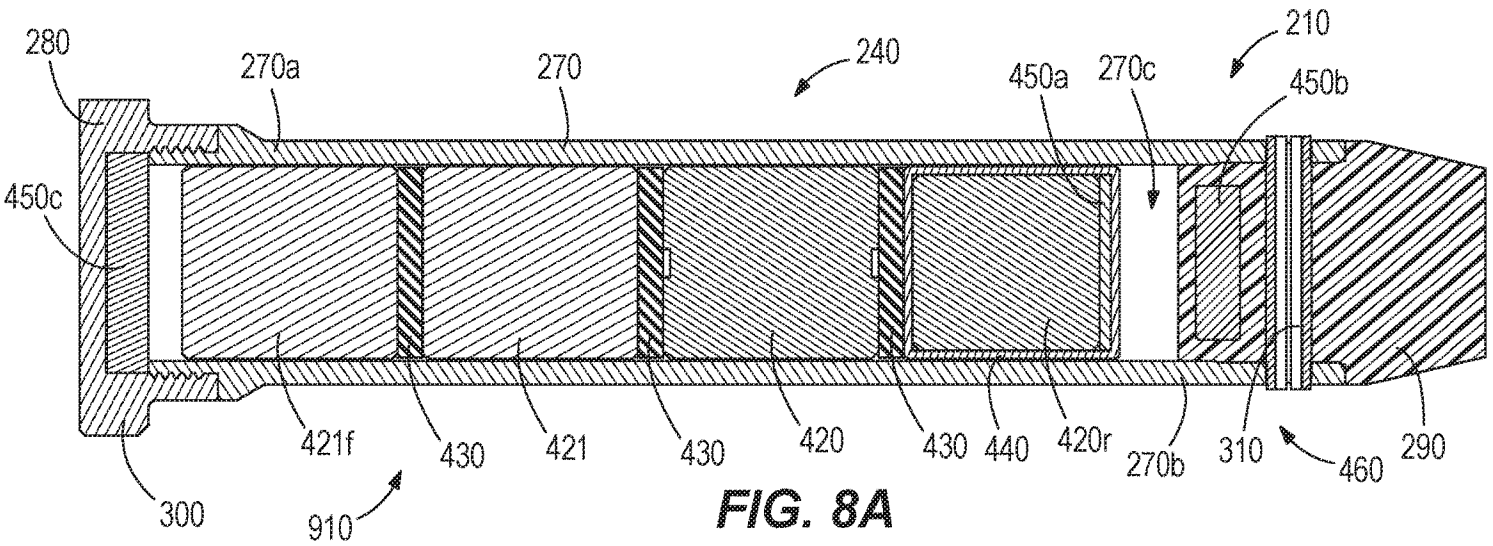
FIG. 8A is a cross-sectional view of a fifth embodiment of the buffer in an at-rest condition.
Figure 8B:
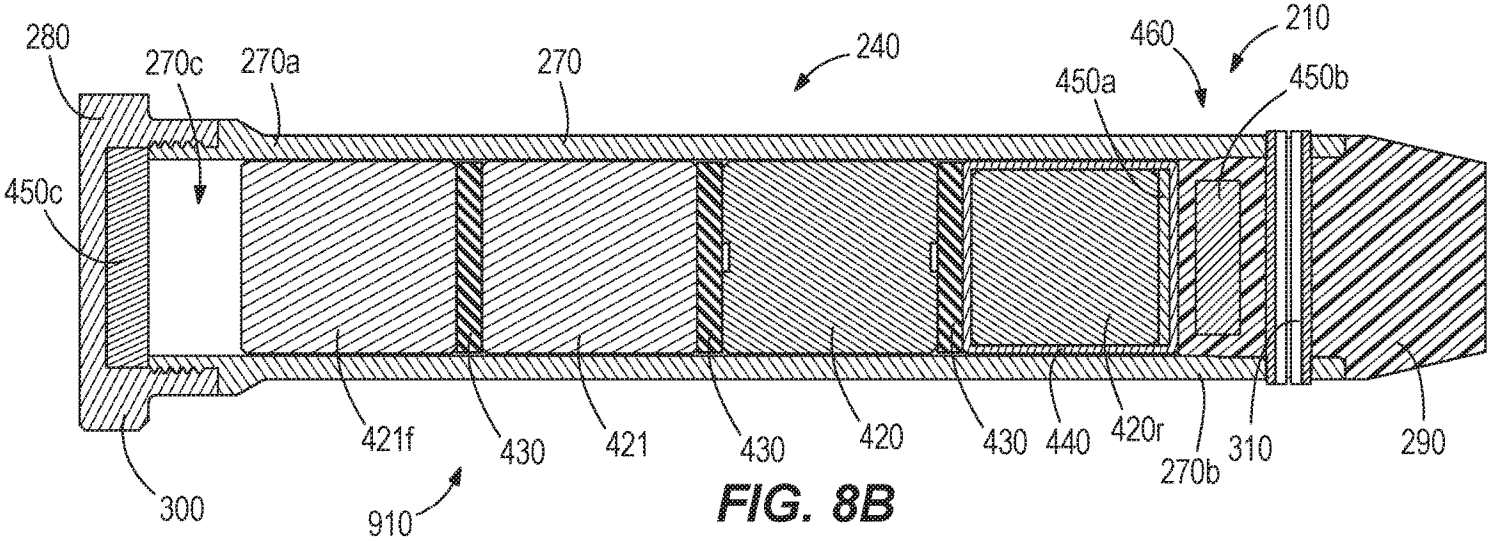
FIG. 8B is a cross-sectional view of the fifth embodiment of the buffer in a dead-blow condition.

FIGS. 8A and 8B illustrate a fifth configuration of an internal assembly 910 of the buffer 240. The internal assembly 910 is most similar to the first embodiment 410. The dead-blow biasing mechanism 460 operates in an identical manner to that of the first embodiment 410 to address an overgassed firearm, but the embodiment illustrated in FIGS. 8A and 8B also includes a third magnet 450*c*. The third magnet 450*c* operates in a similar manner to second magnet 450*b* of the embodiments illustrated in FIGS. 6 and 7, to bias the bolt carrier 215 and the buffer 240 towards each other. The embodiment illustrated in FIGS. 8A and 8B has the added advantage that the third magnet 450*c* has a larger radius than the second magnet 450*b* of the embodiments illustrated in FIGS. 6 and 7. Specifically, the radius of the third magnet 450*c* is larger than a radius of the buffer cavity 270*c*. The front end cap 280 in this embodiment might be threaded onto the front end of the buffer body 270, with the third magnet 450*c* captured between the front end cap 280 and the front end of the buffer body 270. The third magnet 450*c* of the fifth embodiment is therefore more powerful than the second magnet 450*b* of the third and fourth embodiments, and exerts a stronger magnetic attracting force on the bolt carrier 215. This stronger magnetic attracting force further offsets the inertial event at the end of a rearward stroke or a forwards stroke, and thereby further prevents the bolt carrier 215 and the buffer 240 from bouncing off one another.

Figure 9A:
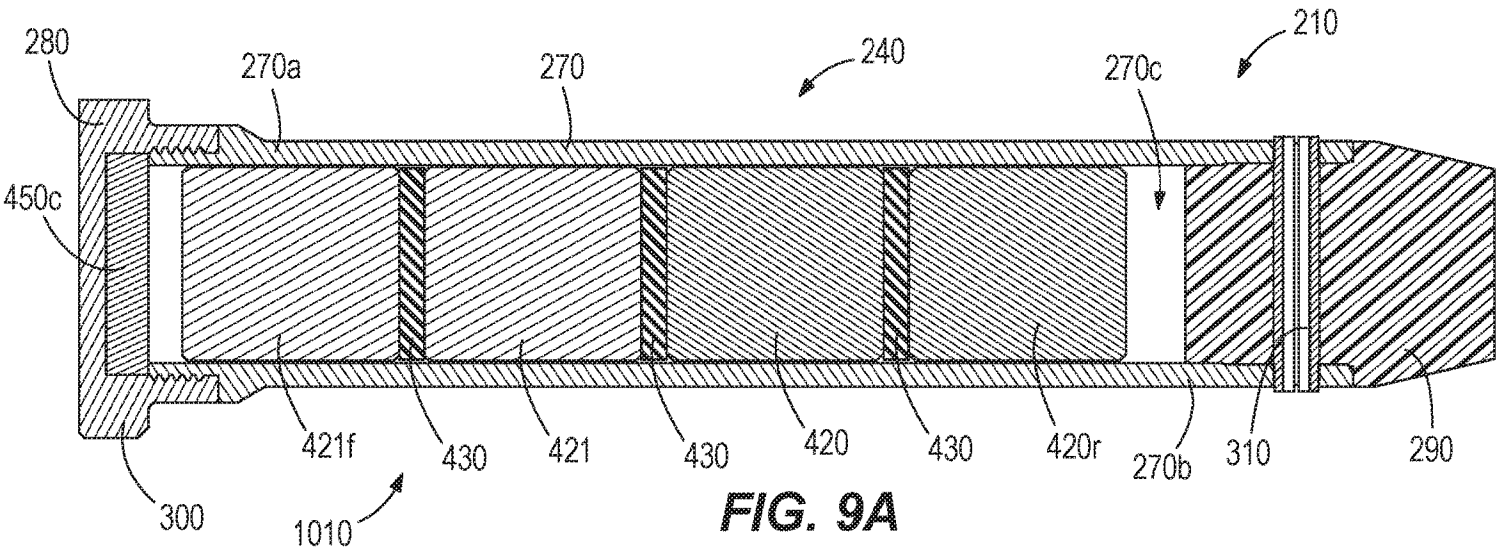
FIG. 9A is a cross-sectional view of a sixth embodiment of the buffer in a forward-directed dead-blow condition.
Figure 9B:
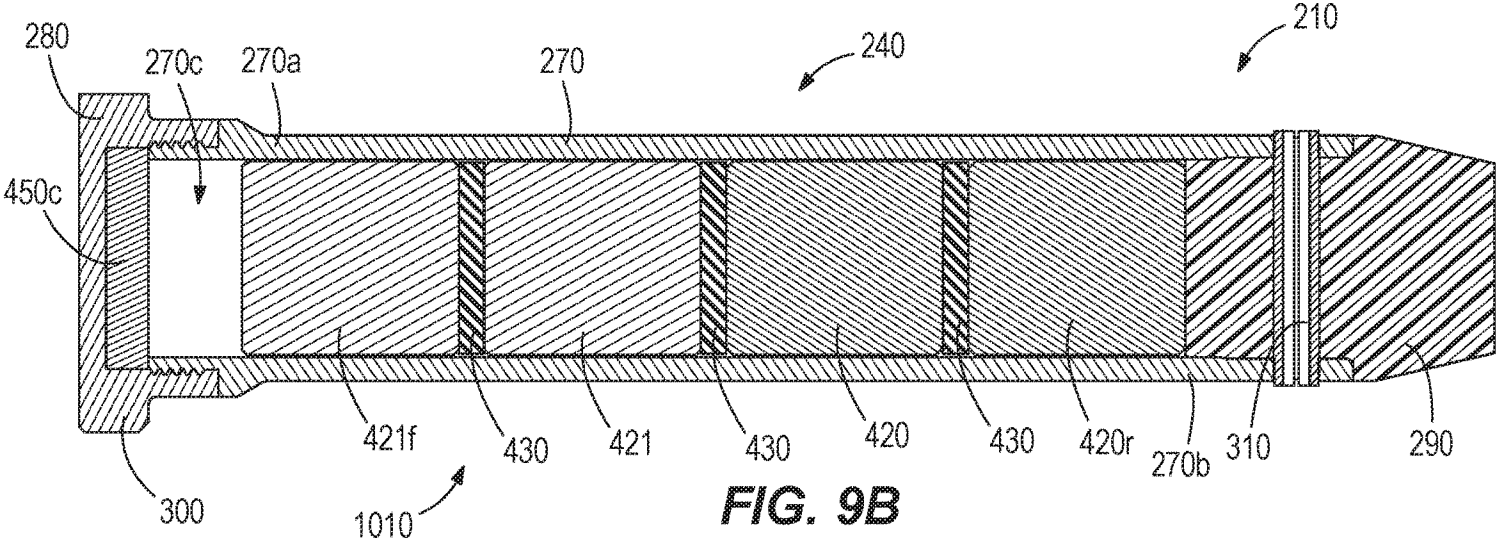
FIG. 9B is a cross-sectional view of the sixth embodiment of the buffer in a rearward-directed dead-blow condition.

FIGS. 9A and 9B illustrate a sixth configuration of an internal assembly 1010 of the buffer 240. The internal assembly 1010 is most similar to the fifth embodiment 910, as the internal assembly 1010 includes a magnet 450*c* with a radius larger than the buffer cavity 270*c*. The magnet 450*c* operates in an identical manner to that of the embodiment illustrated in FIGS. 8A and 8B, to bias the bolt carrier 215 and the buffer 240 towards each other, and to thereby prevent the bolt carrier 215 and the buffer 240 from bouncing off one another. The internal assembly 1010 of the sixth embodiment illustrated in FIG. 9 however does not include a dead-blow biasing member 460 including a first magnet 450*a* and a second magnet 450*b*. In the embodiment illustrated in FIG. 9, the internal assembly does not include a dead-blow biasing member 460 at all. In other embodiments, the internal assembly 1010 may include a dead-blow biasing member 460 that is a spring or another dead-blow biasing mechanism known in the art.

The internal assembly 1010 operates as follows. The internal assembly 1010 is in an at-rest condition (FIG. 9A) when the bolt carrier 215 is in the battery condition. To begin a firing action, the rearward stroke occurs. If the rearward stroke is forceful enough, an inertial event may occur to achieve a dead-blow condition (FIG. 9B), followed by the spacers 430 absorbing impact force at the end of the rearward stroke when the buffer 240 bottoms out. Otherwise the internal assembly 1010 remains in the at-rest condition for the full rearward stroke until the buffer 240 bottoms out. When the buffer 240 bottoms out, another inertial event occurs and the weights 420, 421 slam into the rear end cap 290 to achieve a dead-blow condition (FIG. 9B). The dead-blow condition offsets the inertial event to reduce bounce of the buffer 240 off the buffer tube 220. Bounce of the bolt carrier 215 off of the buffer 240 at the end of a rearward stroke is also reduced by the magnet 450*c*, which exerts a magnetic attracting force on the bolt carrier 215 to bias the bolt carrier 215 towards the buffer 240. At the conclusion of the rearward stroke, the dead-blow condition of the rearward stroke (FIG. 9B) becomes the at-rest condition of the forward stroke. The forward stroke then starts, and if the forward stroke is forceful enough, an inertial event may occur to achieve the dead-blow condition of the forward stroke (FIG. 10B). The spacers 430 handle the impact force in this instance. Otherwise, the internal assembly remains in the at-rest condition for the full forward stroke until the buffer 240 tops out and creates another inertial event. The weights 420, 421 slam into the front end cap 280 to achieve the dead-blow condition, offsetting the inertial event and preventing bounce of the buffer 240 off of the bolt carrier 215. Bounce of the buffer 240 off of the bolt carrier 215 at the end of a forward stroke is also reduced by the magnet 450*c*, which exerts a magnetic attracting force on the buffer 240 to bias the buffer 240 towards the bolt carrier 215. At the conclusion of the forward stroke, the dead-blow condition of the forward stroke (FIG. 9A) becomes the at-rest condition of the rearward stroke as the next rearward stroke begins.

Figure 10A:
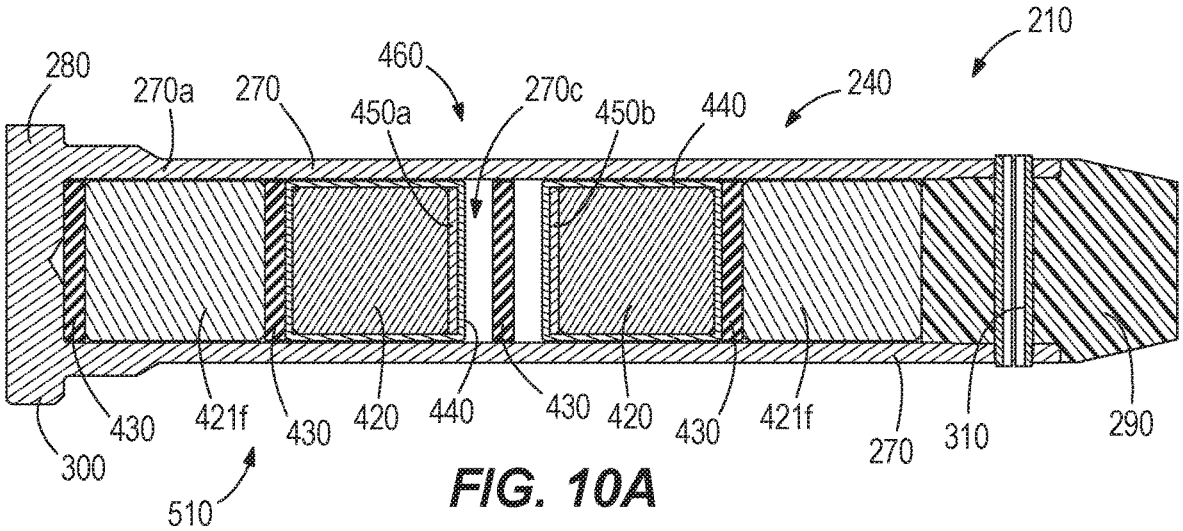
FIG. 10A is a cross-sectional view of a seventh embodiment of the buffer in an at-rest condition.
Figure 10B:
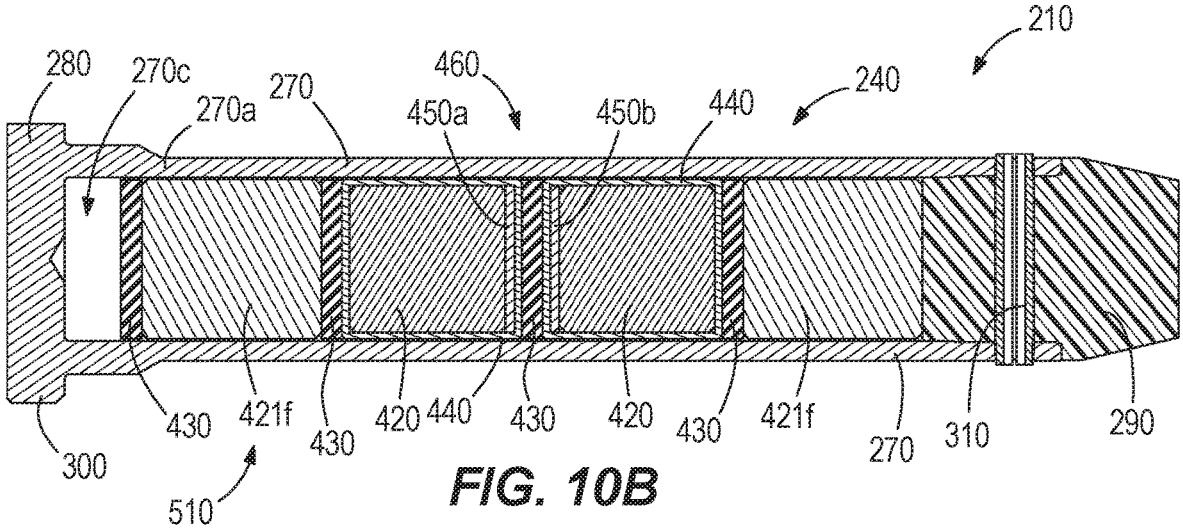
FIG. 10B is a cross-sectional view of the seventh embodiment of the buffer in a rearward-directed dead-blow condition.
Figure 10C:
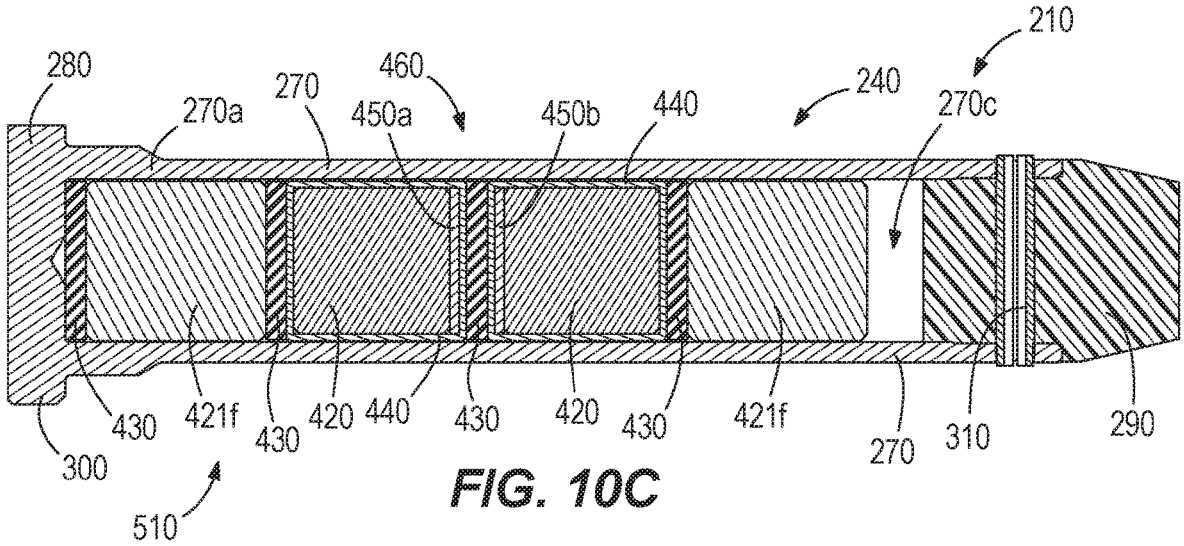
FIG. 10C is a cross-sectional view of the seventh embodiment of the buffer in a forward-directed dead-blow condition.

FIGS. 10A, 10B, and 10C illustrate a seventh embodiment of an internal assembly 510 of the buffer 240. The internal assembly 510 is similar to the first embodiment 410 but the first and second magnets 450*a*, 450*b* are disposed on adjacent faces of adjacent inner weights 420. An at-rest condition of the internal assembly 510 is illustrated in FIG. 10A and first and second dead-blow conditions of the internal assembly 510, following respective inertial events and delay intervals, are illustrated in FIGS. 10B and 10C.

Turning to FIG. 10B, at the end of the rearward stroke, an inertial event occurs which causes the front weights 420, 421*f* to overcome the magnetic biasing mechanism 460 and slide into contact with the rear weights 420, 421*r* with an impact force that is partially cushioned by the resilient spacers 430 to reduce noise and provide compliance. The impact force is of sufficient magnitude and of proper timing to reduce bounce of the buffer 240 and cause the buffer 240 to pause before starting the forward stroke. During the pause, the magnetic biasing mechanism 460 returns the internal assembly 510 to the at-rest condition illustrated in FIG. 10A.

With reference now to FIG. 10C, at the end of the forward stroke, an inertial event occurs which causes the rear weights 420, 421*r* to overcome the magnetic biasing mechanism 460 and slide into contact with the forward weights 420, 421*f* with an impact force that is partially cushioned by the resilient spacers 430 to reduce noise and provide compliance. The impact force is of sufficient magnitude and of proper timing to reduce bounce of the buffer 240 off the bolt carrier 215. Before the rearward stroke begins, the magnetic biasing mechanism 460 returns the internal assembly 510 to the at-rest condition illustrated in FIG. 10A.

Depending on the magnitude and acceleration of the beginning of the forward and rearward strokes, the biasing force of the magnetic biasing mechanism 460 can be overcome to move the weights 420, 421 into the first and second dead-blow conditions of FIGS. 10B and 10C, respectively.

Because only half of the plurality of weights 420, 421 in the embodiments of FIGS. 10A-10C are providing the impact force to reduce the bounce of the buffer 240 as compared to the embodiments of FIGS. 4A-9B, the impact forces provided in the embodiments of FIGS. 10A-10C are generally not as large as those provided by the embodiments of 4A-9. The properties of the weights 420, 421 (such as density, volume, etc.) can be altered so that the weights 420, 421 can provide the required impact forces for desirable operation of the firearm 100.

Thus, the invention provides, among other things, a buffer assembly that includes at least one magnet that offsets an inertial event that occurs during the firing action of a firearm. The magnet thereby reduces, minimizes, or eliminates bounce or rebound of the buffer at the rear end of the buffer tube and/or at the bolt carrier. Various features and advantages of the invention are set forth in the following claims.

What is claimed is:

1. A buffer assembly for a firearm, the buffer assembly comprising:

a buffer tube including a closed rear end;

an action spring in the tube; and a buffer in the tube and engaging the action spring, the buffer including a buffer body that is moveably biased within the buffer tube via the action spring, the buffer body defining an internal buffer cavity, a rear end cap covering a rear end of the buffer body, a front end cap covering a front end of the buffer body, and an internal assembly within the buffer cavity, the internal assembly comprising at least one weight, a first magnet and a second magnet;

wherein a magnetic repelling force between the first magnet and the second magnet biases the weight to an at-rest position within the internal assembly; and wherein in response to an inertial event the at least one weight overcomes the bias of the magnetic repelling force to achieve a dead-blow condition to at least partially offset an effect of the inertial event.

2. The buffer assembly of claim 1, wherein the magnetic repelling force establishes a delay interval between the occurrence of the inertial event and the occurrence of the resulting dead-blow condition.

3. The buffer assembly of claim 1, wherein the first magnet is encapsulated with the weight in an encapsulation.

4. The buffer assembly of claim 1, wherein the inertial event is generated by a rearward stroke of the buffer and the dead-blow condition occurs at the beginning of the rearward stroke.

5. The buffer assembly of claim 4, wherein the first magnet is proximate the weight and the second magnet is at least partially disposed within the rear end cap of the buffer body.

6. The buffer assembly of claim 1, wherein the magnetic repelling force adjusts a magnitude of an impact force arising from the dead-blow condition.

7. The buffer assembly of claim 1, wherein the inertial event is generated by a rearward stroke of the buffer and the dead-blow condition occurs at both a beginning of the rearward stroke and an end of the rearward stroke.

8. The buffer assembly of claim 7, wherein the at least one weight includes a first weight and a second weight, the first weight located rearwardly within the buffer body relative to the second weight, the first magnet is positioned proximate the first weight, and the second magnet is positioned proximate the second weight.

9. The buffer assembly of claim 1, wherein the magnetic repelling force resets the internal assembly to the at-rest condition after a recover time has passed following the occurrence of the dead-blow condition.

10. A firing assembly for a firearm, the firing assembly comprising:

a bolt carrier movable in a rearward stroke and a forward stroke as part of a firing and loading action of the firearm; and a buffer assembly including a buffer tube including a closed rear end, an action spring in the tube, and a buffer in the tube and engaging the action spring, the buffer including a buffer body defining an internal buffer cavity, a rear end cap covering a rear end of the buffer body, a front end cap engaged with the bolt carrier, and an internal assembly within the buffer cavity, the internal assembly comprising at least one weight, a first magnet, and a second magnet;

wherein a magnetic repelling force between the first magnet and the second magnet biases the weight to an at-rest position within the internal assembly;

wherein the buffer is driven in rearward and forward strokes corresponding to the rearward and forward strokes of the bolt carrier and under the influence of respective rearward motion of the bolt carrier and a forward biasing force of the action spring;

wherein as a result of at least one of the rearward and forward strokes, at least one inertial event occurs;

wherein in response to the inertial event the at least one weight overcomes the bias of the magnetic repelling force to achieve a dead-blow condition to at least partially offset an effect of the inertial event.

11. The firing assembly of claim 10, wherein the magnetic repelling force adjusts a magnitude of an impact force arising from the dead-blow condition.

12. The firing assembly of claim 10, wherein the magnetic repelling force establishes a delay interval between the occurrence of the inertial event and to the occurrence of the dead-blow condition.

13. The firing assembly of claim 10, wherein the inertial event is generated by a rearward stroke of the buffer and the dead-blow condition occurs at the end of the rearward stroke.

14. The firing assembly of claim 13, wherein the second magnet is proximate the weight and the first magnet is at least partially disposed within the front end cap of the buffer body.

15. The firing assembly of claim 14, wherein a magnetic attracting force between the first magnet and the bolt carrier biases the bolt carrier towards the buffer body.

16. The firing assembly of claim 13, wherein the first magnet is proximate the weight and the second magnet is at least partially disposed within the rear end cap of the buffer body, wherein the internal assembly further comprises a third magnet disposed at least partially within the front end cap of the buffer body, and wherein a magnetic attracting force between the third magnet and the bolt carrier biases the bolt carrier towards the buffer body.

17. The firing assembly of claim 16, wherein a radius of the third magnet is larger than a radius of the cavity of the buffer body.

18. The firing assembly of claim 10, wherein the magnetic repelling force resets the internal assembly to the at-rest condition after a recover time has passed following the occurrence of the dead-blow condition.

19. A method of at least partially offsetting an inertial event in a firing assembly of a firearm, the method comprising:

evaluating an inertial event of a buffer assembly in a firearm, the buffer assembly having a buffer body, with at least one weight moveable within an internal space of the buffer body, and a first magnet and a second magnet that interact with each other to create a magnetic repelling force that biases the weight to an at-rest position in the internal space, wherein in response to the inertial event the at least one weight overcomes the bias of the magnetic repelling force to achieve a dead-blow condition to at least partially offset an effect of the inertial event, and wherein the magnetic repelling force adjusts a magnitude of an impact force arising from the dead-blow condition and establishes a delay interval between the occurrence of the inertial event and to the occurrence of the dead-blow condition;

determining an impact force that is a minimizing impact force and a delay interval that is a minimizing delay interval such that the minimizing impact force and minimizing delay interval combination at least partially offset the inertial event; and adjusting properties of the components of the firearm to achieve the minimizing impact force and the minimizing delay interval combination.

20. The method of claim 19, wherein the adjusted component properties are those of the first magnet and the second magnet.

21. The method of claim 19, wherein the adjusted component properties are those of the weight.

22. The method of claim 19, wherein the adjusted component properties are those of an encapsulation between the first magnet and the weight.

23. A firing assembly for a firearm, the firing assembly comprising:

a bolt carrier movable in a rearward stroke and a forward stroke as part of a firing and loading action of the firearm; and a buffer assembly including a buffer tube including a closed rear end, an action spring in the tube, and a buffer in the tube and engaging the action spring, the buffer including a buffer body defining an internal buffer cavity, a rear end cap covering a rear end of the buffer body, a front end cap engaged with the bolt carrier, and an internal assembly within the buffer cavity, the internal assembly comprising at least one weight and a magnet;

wherein a magnetic attracting force between the magnet and the bolt carrier biases the bolt carrier and the buffer towards each other;

wherein the buffer is driven in rearward and forward strokes corresponding to the rearward and forward strokes of the bolt carrier and under the influence of respective rearward motion of the bolt carrier and a forward biasing force of the action spring;

wherein as a result of at least one of the rearward and forward strokes, at least one inertial event occurs;

wherein during the inertial event, the magnetic attracting force biases the bolt carrier and the buffer towards each other to at least partially offset an effect of the inertial event.

24. The firing assembly of claim 23, wherein the internal assembly includes a dead-blow biasing mechanism.

25. The firing assembly of claim 24, wherein the dead-blow biasing mechanism includes at least a second magnet.

* * * * *